United States Patent [19]

Berry

[11] 4,027,995

[45] June 7, 1977

[54] STEAM TRACK TURBINE

[76] Inventor: Clyde F. Berry, R.F.D. 7 Box 169 C, Manchester, N.H. 03104

[22] Filed: July 14, 1975

[21] Appl. No.: 595,544

[52] U.S. Cl. ..... 415/92; 415/202
[51] Int. Cl.[2] ..... F01D 1/02
[58] Field of Search ..... 415/202, 203, 92, 76, 415/74, 75, 73; 60/39.44, 73

[56] References Cited

UNITED STATES PATENTS

| | | | |
|---|---|---|---|
| 516,729 | 3/1894 | Byrd | 415/202 |
| 800,684 | 10/1905 | Schneider | 60/39.44 |
| 865,164 | 9/1907 | Corthesy | 415/202 |
| 877,848 | 1/1908 | Lewis | 415/73 |
| 981,311 | 1/1911 | Rivers | 415/76 |
| 1,149,523 | 8/1915 | Jerman, Jr. | 415/202 |
| 1,180,122 | 4/1916 | Fleshman | 415/202 |
| 3,490,851 | 1/1970 | Krzyszczuk | 415/74 |

FOREIGN PATENTS OR APPLICATIONS

| | | | |
|---|---|---|---|
| 1,168,167 | 4/1964 | Germany | 415/202 |
| 3,165 | 2/1891 | Switzerland | 415/202 |

OTHER PUBLICATIONS

The American Inventor, vol. 15, No. 4, p. 101, Pub. at 114–118 Liberty St., New York, New York.

*Primary Examiner*—Henry F. Raduazo
*Attorney, Agent, or Firm*—C. Yardley Chittick

[57] ABSTRACT

The turbine rotor has about its periphery a steam track in the form of a groove. The groove is closed at its leading end by a small face and has walls which diverge in a helical pattern. The bottom and walls of the groove terminate in an outwardly sloping area which meets the closed leading end of the groove. Alternatively there may be a succession of grooves, each with a closed leading ends and diverging walls. Additionally the housing may include a stationary steam track closed at both ends with walls diverging in the opposite direction from the diverging walls of the groove in the rotor.

7 Claims, 9 Drawing Figures

STEAM TRACK TURBINE

BACKGROUND OF THE INVENTION

Conventional steam turbines have a large number of blades mounted about the periphery of the rotor against which the incoming steam impinges. The force applied to the blades to cause movement of the rotor is solely the kinetic energy of the incoming steam.

In a multi-stage turbine, stationary deflector blades mounted on the housing are utilized to shift the steam laterally to impinge on successive sets of blades mounted on other rotors on the same shaft.

SUMMARY OF THE INVENTION

In the present invention, in the preferred form, there is a single circumferentially extending track or groove in the periphery of the rotor. The groove extends for a circumferential distance of nearly 360 °. The groove is closed at its leading and tail ends by the uncut away part of the rotor at this location. The leading end closure presents a small area from which opposed walls or faces of the groove extend circumferentially in a diverging helical pattern of very small pitch. These faces terminate at the tail end of the groove just ahead of the leading end. The bottom of the groove may be of constant radius. In another form, the bottom of the groove may become progressively deeper as it moves from the leading end to the tail end. This provides an increasing projected cross-sectional area against which the steam may act. The tail end of the groove preferably ends in a radially outward sloping surface hereinafter referred to as a talus. The talus terminates at the closed leading end of the groove.

In another form of the invention instead of having a single groove extending about the circumference of the rotor, a plurality of successive aligned grooves may be placed in the periphery of the rotor. Each groove, whether a single groove or plurality of grooves will be of the same nature, namely, closed by a wall at the leading end and having diverging side walls which terminate in a talus reaching to the next following leading end.

The incoming steam aimed tangentially at the rotor initially impinges against the leading small end of the groove to initiate rotation. As rotation of the rotor progresses, the expanding steam exerts an additional rotational force against the constantly increasing projected cross-sectional area of the groove occasioned by the diverging helical faces.

The effect of the present construction is to permit the incoming steam to act on a constantly enlarging area as the rotor turns, whether there be but a single groove or a plurality of successive grooves.

The effectiveness of the construction referred to above may be increased by including in the rotor housing a stationary steam track. This track or groove is formed in the inner periphery of the housing and in alignment with the rotating steam track or tracks in the rotor. The stationary steam track in the housing is narrow at one end and wide at the other with the walls diverging the same as in the rotor but in the opposite direction. Thus, after the leading end of the groove or track in the rotor passes the closed end of the stationary steam track in the housing, the steam has the opportunity to expand between the stationary closed end of the groove in the housing and the closed end of the groove in the moving rotor. In this manner, a rotating force against the rotor is developed both by the kenetic energy of the incoming steam from the intake nozzle and the expansion effect between the ends of the stationary steam track and the rotor steam track. Additional steam tracks may also be placed in the sides of the rotor close to the periphery. In such case, additional intake nozzles would be used to direct steam to all tracks.

BRIEF DESCRIPTION OF THE DRAWINGS

In the drawings,

FIG. 6 is a section near the leading end of the groove and FIG. 7 is a section near the rear end of the groove.

DESCRIPTION OF A PREFERRED EMBODIMENT

Figure 1:
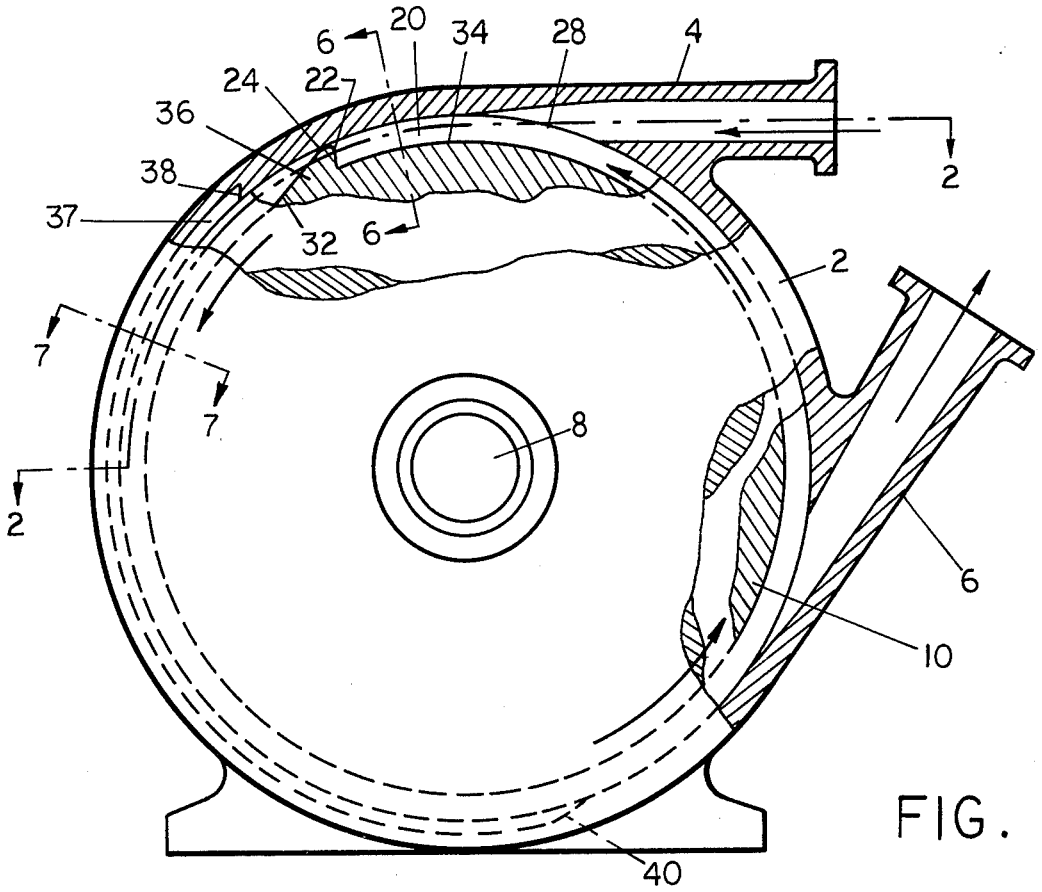
FIG. 1 is a side elevation of a steam turbine housing broken away in part to show the essential features of a rotor having a single steam track therein.
Figure 2:
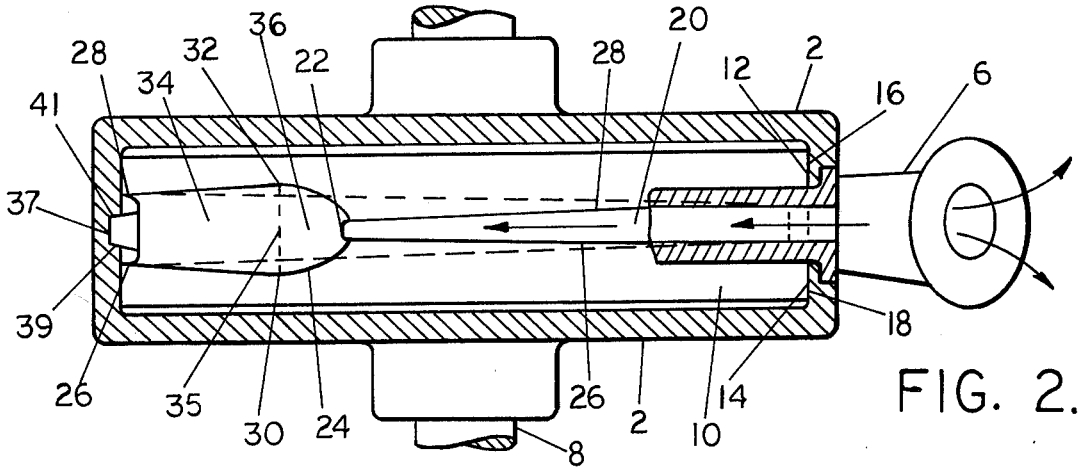
FIG. 2 is a horizontal section taken on the line 2—2 of FIG. 1 showing also a portion of the stationary steam track in the housing.

Referring first to FIG. 1, there is shown in side elevation a steam turbine housing 2, having an intake nozzle 4 and an exhaust nozzle 6. A shaft 8, extending horizontally through the housing 2, carries a rotor 10. As can be seen in FIG. 2, the uncut away peripheral surfaces 12 and 14 of the rotor fit closely within the circular interior surfaces 16 and 18 of the housing 2.

Figure 3:
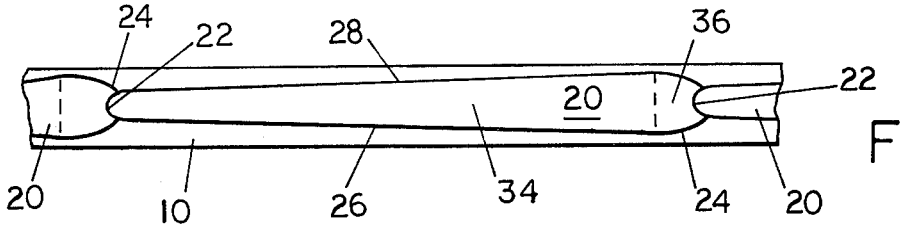
FIG. 3 shows the general nature of the steam track in the rotor when unwound and laid flat.

The rotor 10 has a circumferential track or groove 20 cut or formed in its outer surface. This groove has its closed leading end at 22 and extends for almost 360° terminating in a talus 24 which abuts the leading end 22 of groove 20. As can best be seen in FIGS. 2 and 3 the leading end 22 of groove 20 is of small axial dimension. The walls 26 and 28 of the groove progress from the leading end 22 about the periphery of the rotor in the form of diverging helices which terminate at 30 and 32. The bottom 34 of the groove 20 can be a part of a cylindrical surface of uniform/radius or one designed to give a progressively deepening groove. The bottom 34, which ends at 35 slopes radially outward forming the talus surface as at 36 to meet with the top of the leading end 22 of the groove 20.

From the foregoing explanation it will be understood that steam entering through intake nozzle 4 impinges against closed end 22 of groove 20 and against the projected area of the diverging faces 26 and 28. This puts the rotor, which at the start of operation will be free of any load, into rotation. The steam traveling about the housing in the groove 20, will exhaust through the exhaust nozzle 6. Within a matter of seconds, the rotor 10, still unloaded, will reach high velocity at which time the load may be applied.

Figure 4:
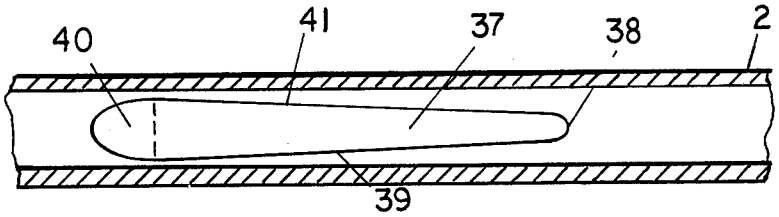
FIG. 4 is similar to FIG. 3, showing the character of the stationary steam track in the housing.

In a modification illustrated in FIGS. 1, 2 and 4 the housing has formed therein a stationary steam track 37. This may have its leading end at any selected location but preferably in the vicinity of intake nozzle 4. In FIG. 1, the closed end at 38 is axially narrow and the walls 39 and 41 extending counterclockwise from end 38 to the talus at 40 diverge in the form of opposing helices of very small pitch. Walls 39 and 41 are similar to the diverging walls 26 and 28 in the rotor 10. However, it should be noted that walls 39 and 41 in the stationary steam track 37 diverge in the opposite direction from those in the rotor.

Thus, when the shoulder 22 of rotor groove 20 passes the stationary closed end 38 of groove 37, the steam in the stationary groove can expand and in so doing drive the shoulder 22 in a counter-clockwise direction as viewed in FIG. 1, adding to the kinetic energy applied to shoulder 22 by the steam entering from intake nozzle 4. The flow of steam from the nozzle 4 into groove 20 is never interrupted because the talus 24 is directly adjacent leading end 22.

Figure 5:
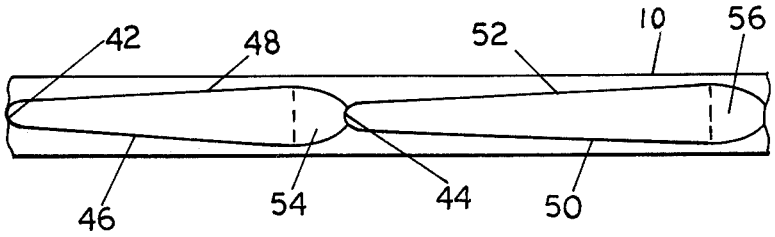
FIG. 5 shows a modification in which there are two steam tracks in the rotor, one following the other as distinguished from the single steam track in the rotor shown in FIGS. 1, 2 and 3.

In the modification shown in FIG. 5, there are two steam tracks in the rotor, each extending substantially 180°. Thus there are two leading end pressure shoulders 42 and 44, and two sets of diverging walls, 46 and 48, and 50 and 52 as well as two talus areas 54 and 56.

Figure 6:
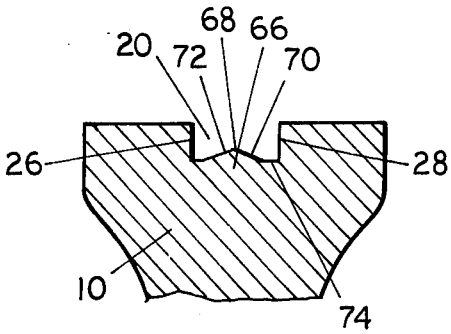
FIGS. 6 and 7 are related sections showing a modified type of rotor groove.
Figure 7:
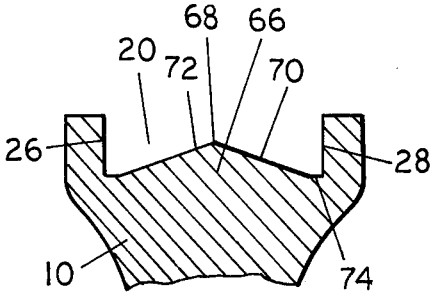

FIGS. 6 and 7 show a modified construction of the bottom of the steam track. These are cross-sectional views taken respectively near the leading and rear ends of the modified steam track. In this modification, the bottom of the groove 20 has a central ridge 66 extending about its full length. The crest 68 is of constant radius and the sidewise slope of the bottom portions 70 and 72 is uniform. These sloping portions may directly intersect the walls 26 and 28 or there may be as shown a narrow flat area 74 therebetween. In either case, the helical walls 26 and 28 increase in radial dimension as the talus 24 is approached.

The design of FIGS. 6 and 7 will produce a larger effective area for the steam to act against with a resulting larger power output for the same steam consumption required in the form shown in FIGS. 1 and 2.

In still a further modification, additional steam tracks or grooves may be cut into the side faces of the rotor and stationary steam tracks or grooves correspondingly formed in the wall of the housing.

Figure 8:
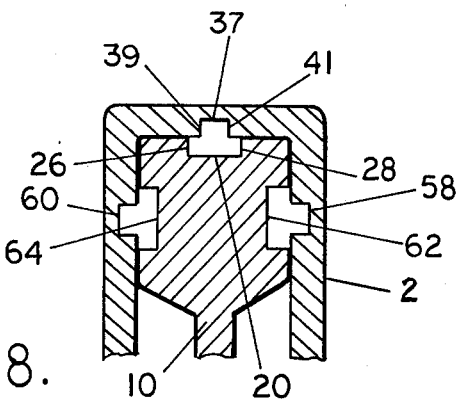
FIG. 8 shows a modification in which steam track shave been placed in the outer faces of the rotor.

Thus in FIG. 8, which is a section taken angularly closer the the talus 36 than to the leading end 22 the housing 2 has stationary steam tracks or grooves 37, 58 and 60 and the rotor 10 has not only groove 20 but also grooves 62 and 64 in the side faces. Grooves 58 and 60 are of the same nature as groove 37 with the walls diverging in a counter-clockwise direction as viewed in FIG. 1.

The closed ends of grooves 62 and 64 may be staggered with respect to closed end 22 of groove 20. Similarly the closed ends of grooves 58 and 60 may be staggered with respect to closed end 38 of groove 37.

The construction of FIG. 8 gives the steam a greater area to act against thereby to increase the power output of the turbine with of course greater steam consumption.

Figure 9:
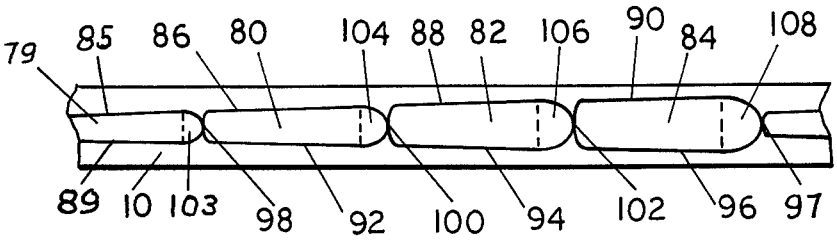
FIG. 9 shows a plurality of successive tracks with aligned walls completing one circumference.

FIG. 9 illustrates another modification to be considered within the scope of the invention. Here there are a succession of tracks 79,80, 82 and 84 in the outer circumference of the rotor 10. This form however differs from the construction of FIG. 5 in that the faces 85,86,88 and 90 on one side and the faces 89,92,94 and 96 on the other are aligned in two diverging helices. The leading ends 97,98,100 and 102 are of increasing areas and likewise the talus areas 103,104,106 and 108 are successively larger.

When in the claims reference is made to a groove in the rotor or a groove in the housing, it is to be understood that this contemplates not only a single groove or track extending about the rotor and the housing, but also a plurality of successive grooves or tracks about the housing and rotor in both the periphery and sides of the housing and rotor. The term groove in the claims also is intended to include two or more grooves side by side in the periphery of the rotor and two or more grooves side by side in the faces of the rotor. In all cases where there are a plurality of grooves in the rotor, it will be understood that there will be one or more intake nozzles properly positioned to deliver steam to these grooves to provide maximum driving effect.

The above disclosure is illustrative and not limiting and will suggest to others skilled in the art modification which will be within the scope of the invention as defined by the appended claims.

I claim:

1. A steam turbine comprising a stationary housing, a rotor mounted for rotation within said housing, said rotor having a steam groove about its periphery, said groove being closed at its leading end and tail end by faces of unequal areas, a steam intake nozzle associated with said housing and aligned substantially tangentially with said rotor whereby steam can be directed into said groove toward said leading end to cause rotation of said rotor, a steam exhaust nozzle associated with said housing and positioned angularly beyond said intake nozzle where it receives exhaust steam continuously from said rotating groove, the circumferential walls of said groove being in the form of opposed diverging helices of small pitch starting at the smaller leading end face of the groove and terminating at the larger tail end face of the said groove and a circumferentially extending pressure dividing ridge forming the bottom of said groove, said ridge having a crest and continuous uninterrupted sloping surfaces extending away from said crest toward said walls.

2. The construction set forth in claim 1, the crest of said pressure dividing ridge being of constant radius and the sloping faces of said ridge meeting the bottom of said groove along lines of increasing width and decreasing radius.

3. A steam turbine comprising a stationary housing, a rotor mounted for rotation within said housing, said rotor having a steam groove about its periphery, said groove being closed at its leading end and tail end by faces of unequal areas, a steam intake nozzle associated with said housing and aligned substantially tangentially with said rotor whereby steam cn be directed into said groove toward said leading end to cause rotation of said rotor, a steam exhaust nozzle associated with said housing and positioned angularly beyond said intake nozzle where it receives exhaust steam continously from said rotating groove, the circumferential walls of said groove being in the form of opposed diverging helices of small pitch starting at the smaller leading end face of the groove and terminating at the larger tail end face of the said groove and a stationary steam groove in said housing aligned with the steam groove in said rotor.

4. The construction set forth in claim 3, the said stationary steam groove in said housing having diverging side walls.

5. The construction set forth in claim 4, said side walls diverging in the opposite direction from the walls in said rotor.

6. The construction set forth in claim 3, said rotor having a steam groove about a side face of said rotor and another stationary steam groove in said housing aligned with the said steam groove in the side face of said rotor.

7. The construction set forth in claim 6, the side walls of the said steam groove in the side face of the rotor and the side walls of the stationary steam groove in said housing diverging in opposite directions.

* * * * *